US006537022B1

(12) United States Patent
Housley et al.

(10) Patent No.: US 6,537,022 B1
(45) Date of Patent: Mar. 25, 2003

(54) NOZZLE LOCK FOR GAS TURBINE ENGINES

(75) Inventors: Christopher George Housley, Liberty Township, OH (US); Donald Franklin Enzweiler, Burlington, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/972,088

(22) Filed: Oct. 5, 2001

(51) Int. Cl.[7] ..... F01D 9/04

(52) U.S. Cl. ..... 415/189; 415/191; 415/209.2; 415/209.3

(58) Field of Search ..... 415/189, 191, 415/208.2, 209.2, 209.3, 211.2

(56) References Cited

U.S. PATENT DOCUMENTS 3,781,125 A * 12/1973 Rahaim et al. ..... 451/115
5,176,496 A 1/1993 Correia et al.
5,201,846 A * 4/1993 Sweeney
5,211,532 A 5/1993 Thompson
5,343,694 A 9/1994 Toborg et al.
5,775,874 A * 7/1998 Boite et al. ..... 415/209.3
5,839,878 A * 11/1998 Maier
6,095,750 A 8/2000 Ross et al.

* cited by examiner

*Primary Examiner*—Edward K. Look
*Assistant Examiner*—Ninh Nguyen
(74) *Attorney, Agent, or Firm*—Nathan D. Herkamp; Pierce Atwood

(57) ABSTRACT

A nozzle lock for circumferentially securing a nozzle segment relative to the engine casing of a gas turbine engine. The nozzle lock includes a thickener pad joined to an outer surface of the engine casing and a locking member disposed in a notch located in the outer band of the nozzle segment. A pin formed on the locking member is press-fit into the casing and the thickener pad.

12 Claims, 4 Drawing Sheets

NOZZLE LOCK FOR GAS TURBINE ENGINES

BACKGROUND OF THE INVENTION

This invention relates generally to gas turbine engines and more particularly to nozzle locks for circumferentially securing turbine nozzles in such engines.

A gas turbine engine includes a compressor that provides pressurized air to a combustor wherein the air is mixed with fuel and ignited for generating hot combustion gases. These gases flow downstream to one or more turbines that extract energy therefrom to power the compressor and provide useful work such as powering an aircraft in flight. Each turbine stage commonly includes a turbine rotor and a stationary turbine nozzle for channeling combustion gases into the turbine rotor disposed downstream thereof. The turbine rotor includes a plurality of circumferentially spaced apart blades extending radially outwardly from a rotor disk that rotates about the centerline axis of the engine. The nozzle includes a plurality of circumferentially spaced apart vanes radially aligned with the rotor blades. Turbine nozzles are typically segmented around the circumference thereof with each nozzle segment having one or more nozzle vanes disposed between inner and outer bands that define the radial flowpath boundaries for the hot combustion gases flowing through the nozzle.

In a typical mounting arrangement, the outer band of each nozzle segment includes flanges or hooks for coupling the nozzle segment to the inner surface of the engine casing. The inner bands are ordinarily coupled to stationary support structure within the engine. These arrangements provide radial and axial support for the turbine nozzle. During operation, turbine nozzles also generate substantial tangential loads because of the hot gas flow passing therethrough. Gas turbine engines use anti-rotation devices, referred to as nozzle locks, to circumferentially secure the turbine nozzle relative to the engine casing and react the tangential loads.

One known nozzle lock arrangement includes a locking member having two lugs and an integral threaded stud. The locking member is installed from the interior of the engine casing so that the first lug is received in a notch formed in the outer band of one nozzle segment and the second lug is received in a notch formed in the outer band of an adjacent nozzle segment. The threaded stud extends through an opening in the casing and is secured by a nut threaded onto the stud from the exterior of the casing. This nozzle lock arrangement causes the accumulation of nozzle load stress and fastener pre-load stress to occur at the same location, i.e., at the undercut fillet at the base of the threaded stud. This nozzle lock also reacts the tangential load for two nozzle segments. As a result, these nozzle locks can be susceptible to fatigue damage and rupture.

Accordingly, it would be desirable to have a nozzle lock that is less susceptible to fatigue damage and rupture.

BRIEF SUMMARY OF THE INVENTION

The above-mentioned need is met by the present invention, which provides a nozzle lock for a gas turbine engine having an engine casing and at least one nozzle segment disposed inside the engine casing. The nozzle lock includes a thickener pad joined to an outer surface of the engine casing and a locking member disposed in a notch located in the outer band of the nozzle segment. A pin formed on the locking member is press-fit into the casing and the thickener pad.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
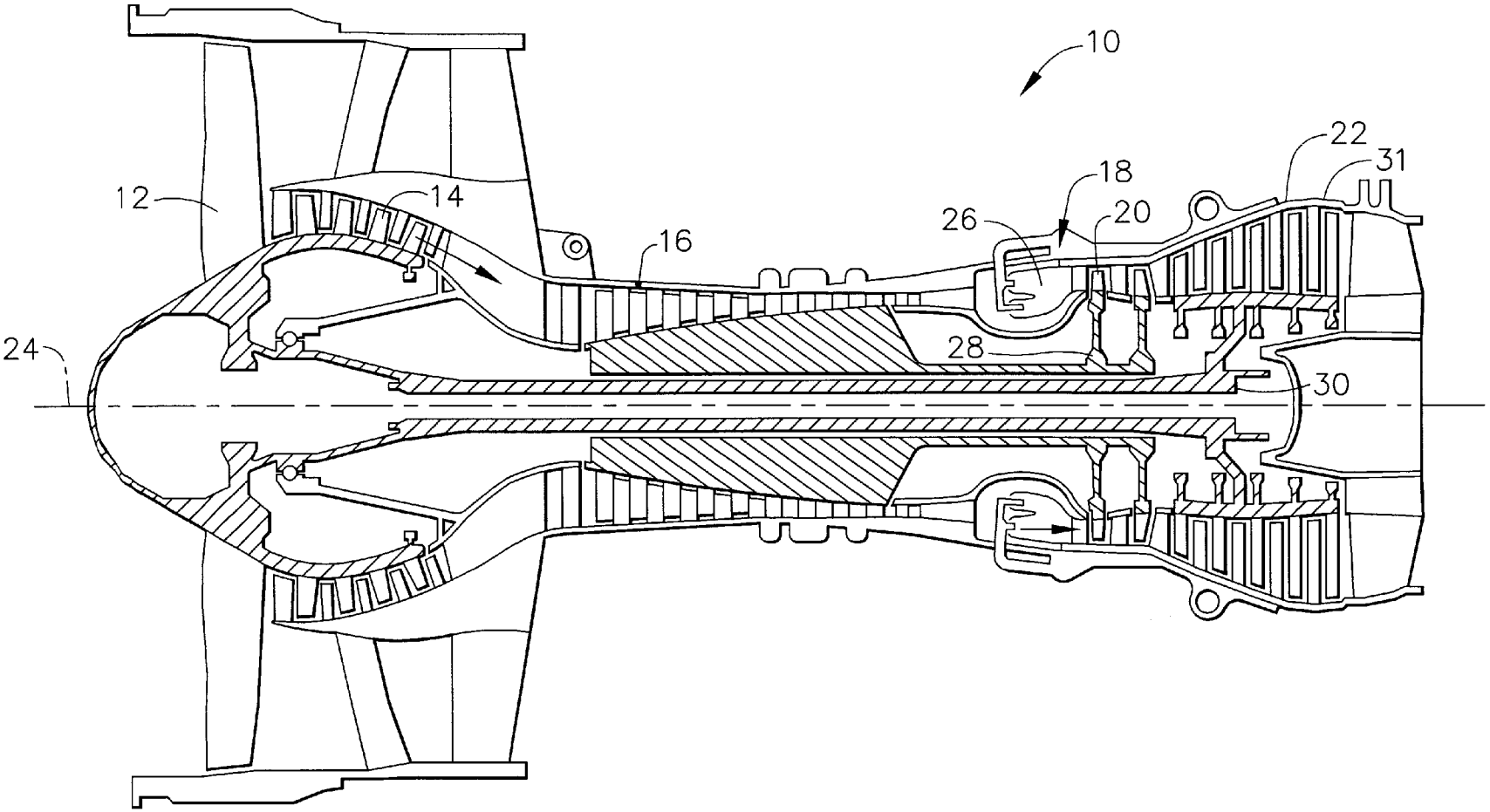
FIG. 1 is a schematic, longitudinal sectional view of an exemplary turbofan gas turbine engine having the turbine nozzle lock of the present invention.

Referring to the drawings wherein identical reference numerals denote the same elements throughout the various views, FIG. 1 shows an exemplary turbofan gas turbine engine 10 including, in serial flow communication, a fan 12, a booster or low pressure compressor 14, a high pressure compressor 16, a combustor 18, a high pressure turbine 20, and a low pressure turbine 22, all disposed coaxially about a longitudinal or axial centerline axis 24. The combustor 18 includes a generally annular hollow body defining a combustion chamber 26 therein. The booster 14 and the high pressure compressor 16 provide compressed air that passes primarily into the combustor 18 to support combustion and partially around the combustor 18 where it is used to cool both the combustor liners and turbomachinery further downstream. Fuel is introduced into the forward end of the combustor 18 and is mixed with the air in a conventional fashion. The resulting fuel-air mixture flows into the combustion chamber 26 where it is ignited for generating hot combustion gases. The hot combustion gases are discharged to the high pressure turbine 20 located immediately downstream of the combustor 18 where they are expanded so that energy is extracted. The hot gases then flow to the low pressure turbine 22 where they are expanded further. The high pressure turbine 20 drives the high pressure compressor 14 through a high pressure shaft 28, and the low pressure turbine 22 drives the fan 12 and the booster 14 through a low pressure shaft 30 disposed within the high pressure shaft 28.

The high pressure turbine 20 and the low pressure turbine 22 each include a number of turbine stages disposed within an engine casing 31. As shown in FIG. 1, the high pressure turbine 20 has two stages and the low pressure turbine 22 has five stages, although it should be noted that different numbers of stages are possible. Each turbine stage includes a turbine rotor and a stationary turbine nozzle for channeling combustion gases into the turbine rotor disposed downstream thereof. Generally, each turbine rotor includes a plurality of circumferentially spaced apart blades extending radially outwardly from a rotor disk that rotates about the centerline axis of the engine 10. The blades include airfoil portions that extend into the gas flow. A plurality of arcuate shrouds is arranged circumferentially in an annular array so as to closely surround the rotor blades and thereby define the outer radial flowpath boundary for the hot combustion gases flowing through the turbine rotor. Each turbine nozzle generally includes a plurality of circumferentially spaced vanes that are supported between a number of arcuate outer bands and arcuate inner bands. The vanes, outer bands and inner bands are arranged into a plurality of circumferentially adjoining nozzle segments that collectively form a complete 360° assembly. The vanes have airfoils that are configured so as to optimally direct the combustion gases to the turbine rotor. The outer and inner bands of each nozzle segment define the outer and inner radial boundaries, respectively, of the gas flow through the nozzle.

Figure 2:
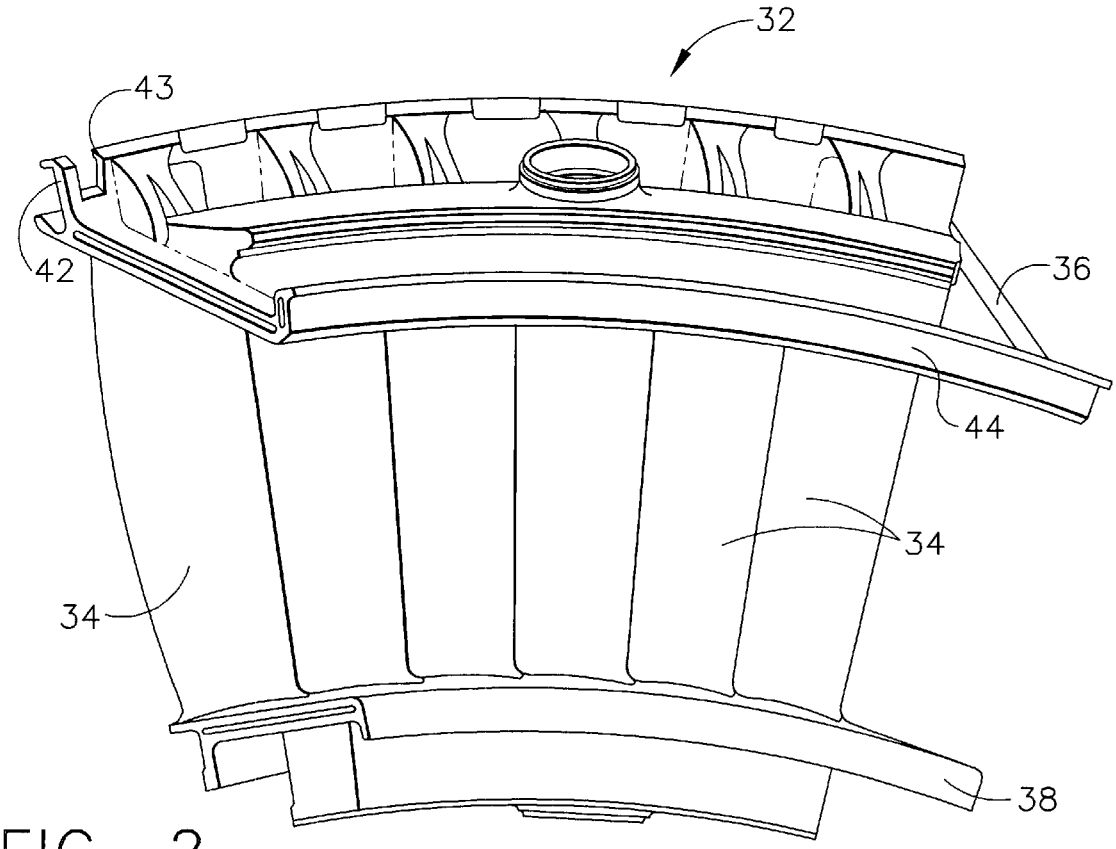
FIG. 2 is a perspective view of a nozzle segment from the gas turbine engine of FIG. 1.

FIG. 2 shows a nozzle segment 32 from one of the turbine nozzles of the low pressure turbine 22. The nozzle segment 32 has five vanes 34 disposed between an outer band 36 and an inner band 38. It should be noted that the present invention is not limited to nozzle segments having five vanes, as nozzle segments having other numbers of vanes are known. Furthermore, although the present invention is being described herein in conjunction with a low pressure turbine nozzle, it should be understood that the present invention is also applicable to high pressure turbine nozzles. The outer band 36 includes a forward rail 40 and an aft rail 42 that are used to couple the nozzle segment 32 to the engine casing 31 in a manner to be described below. A cutout or notch 43 is formed in the aft rail 42, the purpose of which also will be described below. The inner band 38 includes a plurality of flanges or rails that are used to couple the nozzle segment 32 to stationary engine structure in a conventional manner.

Figure 3:
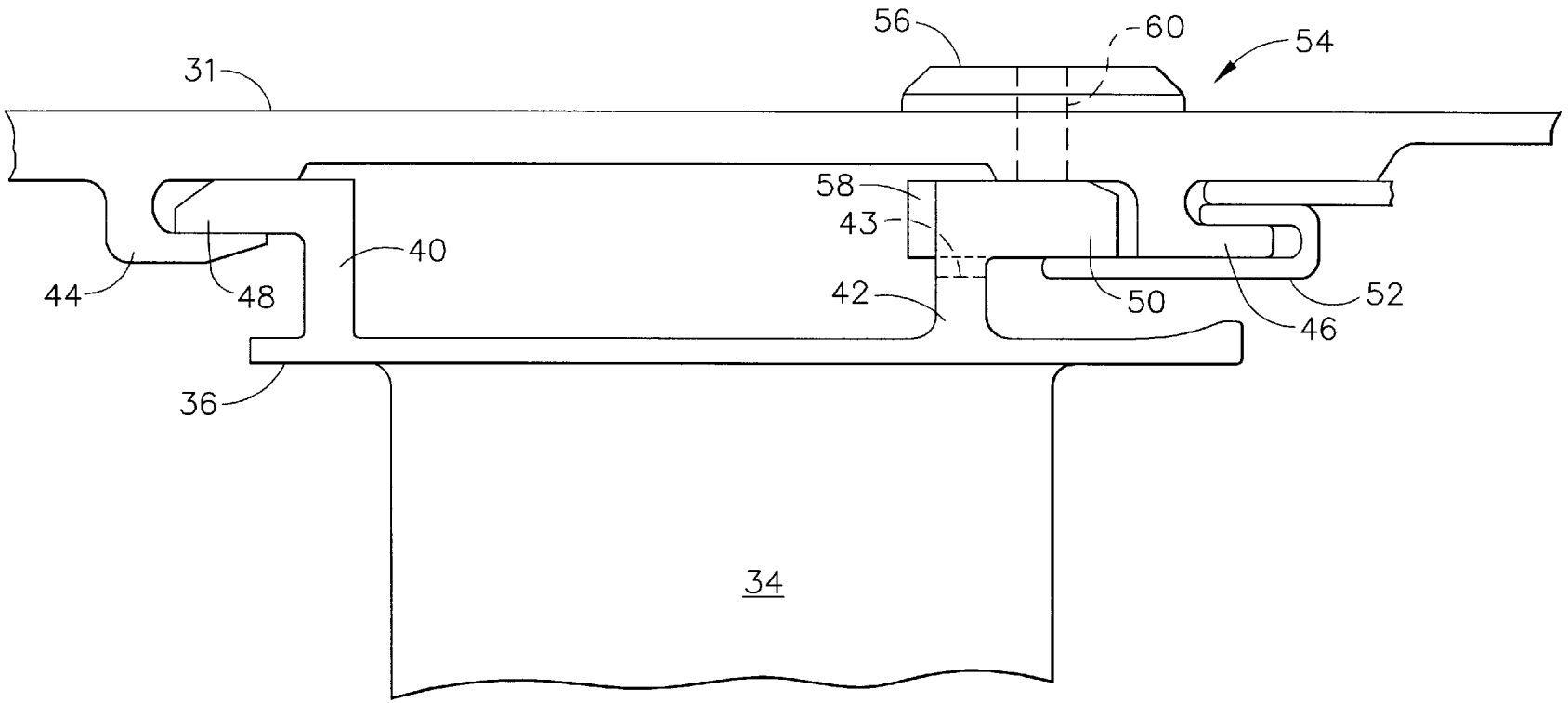
FIG. 3 is a partial side view of the nozzle segment of FIG. 2.
Figure 4:
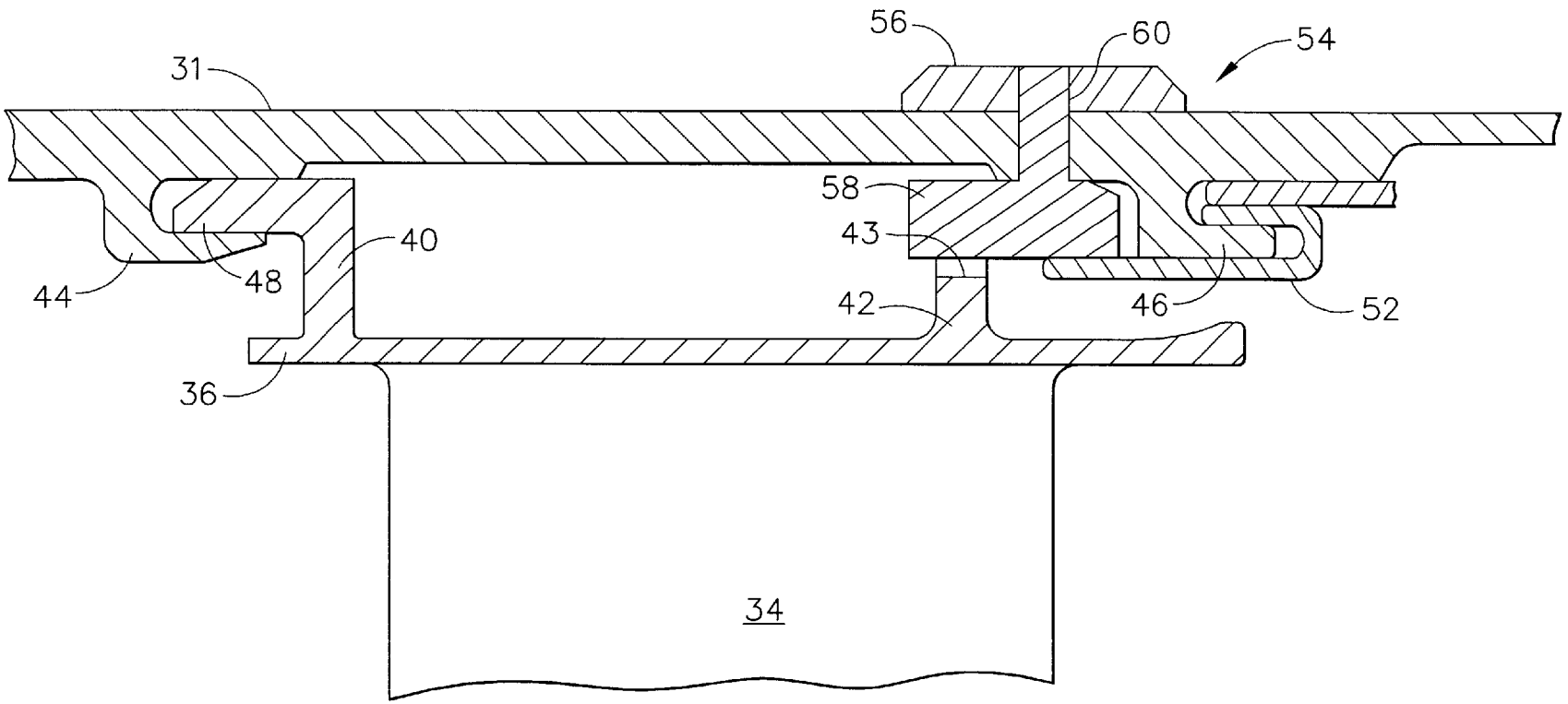
FIG. 4 is a partial cross-sectional view of the nozzle segment of FIG. 2.

Referring now to FIGS. 3 and 4, the outer mounting arrangement for the nozzle segment 32 is described in more detail. Specifically, the casing 31 has a first hook 44 formed on the inner surface thereof and a second hook 46 formed on the inner surface thereof, aft of the first hook 44. The outer band forward rail 40 is provided with a forwardly extending flange 48 that is disposed between the first hook 44 and the casing 31. The outer band aft rail 42 is provided with a rearwardly extending flange 50 that is disposed between the casing 31 and a hanger 52 supported by the second hook 46. This arrangement provides radial and axial support for the nozzle segment 32.

Figure 5:
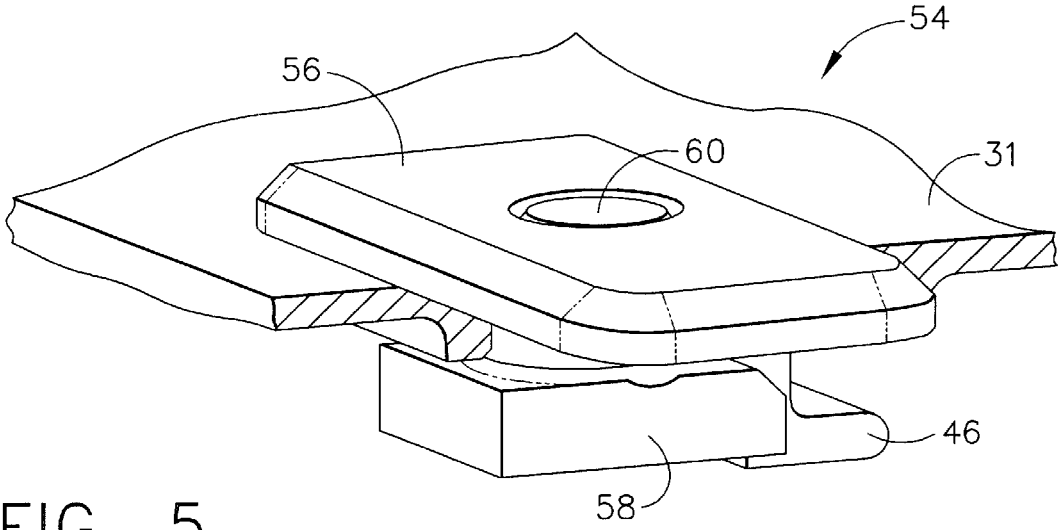
FIG. 5 is a partial perspective view of a nozzle lock located on an engine casing, with the nozzle segment omitted and the casing shown in cut-away.

The mounting arrangement further includes a nozzle lock 54 that reacts tangential loads and prevents circumferential rotation of the nozzle segment 32 relative to the engine casing 31. Referring to FIG. 5 in addition to FIGS. 3 and 4, the nozzle lock 54 includes a thickener pad 56 joined to the outer surface of the casing 31, at an axial position that is in line with the axial location of the aft rail 42. A locking member 58 is disposed in the notch 43 in the aft rail 42. The nozzle segment 32 is positioned such that the notch 43, locking member 58 and thickener pad 56 are generally all at the same circumferential position relative to the casing 31. More particularly, the casing 31 and the thickener pad 56 are each provided with a pin hole and all of the pin holes are aligned with one another. A press-fit pin 60 is formed on the radially outer surface of the locking member 58. The press-fit pin 60 is inserted into the pin holes so as to secure the locking member 58 circumferentially with respect to the casing 31. The circumferentially fixed locking member 58 disposed in the notch 43 thus prevents circumferential rotation of the nozzle segment 32 relative to the engine casing 31.

The thickener pad 56 can be either a separate piece that is attached to the casing 31 by any suitable means, such as a fillet weld, or can be integrally formed with the casing 31. The use of the thickener pad 56 thus lends itself to both field rework or retrofits as well as new manufactures. The thickener pad 56 has sufficient thickness so as to provide additional wheelbase for the press-fit pin 60 to react the tangential nozzle load. In one embodiment, the thickness of the thickener pad 56 is approximately equal to the casing thickness. Without the thickener pad 56, the thickness of the casing 31 alone would be insufficient to react tangential nozzle load without distress. The pin 60 is press-fit into the pin holes with sufficient interference to prevent the pin 60 from coming loose during engine operation. The press-fit concept also eliminates fastener pre-load stress. Furthermore, the nozzle lock 54 reacts the tangential load of a single nozzle segment, as opposed to reacting the tangential load of two nozzle segments as is the case with some prior nozzle locks.

The body of the locking member 58 is sized to fit snugly in the notch 43 to avoid looseness and rattling. The notch 43 could be formed in any circumferential location along the aft rail 42. The aft rail 42 could be provided with more than one such notch for convenience although only a single notch is sufficient. The press-fit pin 60 is off-centered relative to the locking member 58 in the axial direction. That is, the pin 60 is closer to the aft end of the locking member than the forward end. This means that the locking member 58 can only be installed in the correct orientation. The press-fit pin 60 is also provided with an increased undercut fillet radius at the junction of the body of the locking member 58 and the pin diameter. This has a positive impact on design life relative to current nozzle locks.

While specific embodiments of the present invention have been described, it will be apparent to those skilled in the art that various modifications thereto can be made without departing from the spirit and scope of the invention as defined in the appended claims.

What is claimed is:

1. A nozzle lock for circumferentially securing a turbine nozzle segment relative to an engine casing in a gas turbine engine, said nozzle lock comprising:

a thickener pad adapted to be joined to an outer surface of said engine casing;

a locking member adapted to be received in a notch formed in said nozzle segment; and a pin formed on said locking member and press-fit into said thickener pad.

2. The nozzle lock of claim 1 wherein said thickener pad has a pin hole formed therein for receiving said pin.

3. The nozzle lock of claim 1 wherein said pin is off-centered relative to said locking member.

4. The nozzle lock of claim 1 wherein said thickener pad has a thickness that is approximately equal to the thickness of said engine casing.

5. A nozzle lock for a gas turbine engine, said nozzle lock comprising:

an engine casing;

at least one nozzle segment disposed inside said engine casing, said nozzle segment including an outer band, an inner band and at least one vane disposed between said outer band and said inner band, said outer band having a notch formed therein;

a thickener pad joined to an outer surface of said engine casing;

a locking member disposed in said notch; and a pin formed on said locking member and press-fit into said casing and said thickener pad.

6. The nozzle lock of claim 5 wherein said casing and said thickener pad each have a pin hole formed therein for receiving said pin.

7. The nozzle lock of claim 5 wherein said pin is off-centered relative to said locking member.

8. The nozzle lock of claim 5 wherein said locking member fits snugly into said notch.

9. The nozzle lock of claim 5 wherein said outer band includes an aft rail and said notch is located in said aft rail.

10. The nozzle lock of claim 5 wherein said thickener pad has a thickness that is approximately equal to the thickness of said engine casing.

11. The nozzle lock of claim 5 wherein said thickener pad is welded to said engine casing.

12. The nozzle lock of claim 5 wherein said thickener pad is integrally formed with said engine casing.

* * * * *